United States Patent [19]

Jennings

[11] 4,005,696

[45] Feb. 1, 1977

[54] COMPOUND BOW

[75] Inventor: Thomas Paul Jennings, Sun Valley, Calif.

[73] Assignee: Jennings Compound Bow, Inc., Valencia, Calif.

[22] Filed: Mar. 28, 1975

[21] Appl. No.: 562,816

[52] U.S. Cl. ..... 124/24 R; 124/90

[51] Int. Cl.[2] ..... F41B 5/00

[58] Field of Search ..... 124/23 R, 24 R, 30 R, 124/30 A; 273/73 D; 24/115 R, 115 K

[56] References Cited

UNITED STATES PATENTS

| | | | |
|---|---|---|---|
| 1,189,097 | 6/1916 | Hahn | 24/115 R |
| 2,789,003 | 4/1957 | Wirkkala | 24/115 R X |
| 2,947,301 | 8/1960 | Haulk | 124/30 A |
| 3,630,523 | 12/1971 | Lacoste | 273/73 D |
| 3,812,835 | 5/1974 | Smith | 124/30 A X |

*Primary Examiner*—Paul E. Shapiro
*Assistant Examiner*—William R. Browne
*Attorney, Agent, or Firm*—Ellsworth R. Roston

[57] ABSTRACT

A compound bow having a center portion with a handle formed thereon, a lower limb and an upper limb connected to the center portion and eccentrically mounted bow string pulleys mounted at the outer ends of each of the limbs for supporting a bow string. Bow string holders are supported by each of the eccentrically mounted pulleys with each of the bow string holders having a shaft that is connected at its outer end through a cable to one of the pulleys. At least a pair of bow string support members extend from either side of the shaft with the bow string support members being positioned at the inner end of the shaft. Each of the support members includes an upwardly extending outer end which is shaped and positioned to maintain a bow string between the outer end and the shaft. Thus, the end of a bow string may be readily connected to a bow string holder by passing a closed loop at the end of the bow string over one of the support members, then under the bow string holder, and then over the other of the support members.

23 Claims, 4 Drawing Figures

COMPOUND BOW

BACKGROUND OF THE INVENTION

Previously, the bow string of a compound bow has been connectable to an eccentrically mounted pulley positioned at the end of one of the bow limbs by means of a hook connector. The hook was, thus, supported by a draw cable leading to an eccentrically mounted pulley with the free end of the hook being slipped under a closed loop at the end of the draw string to connect the draw string to the eccentrically mounted pulley.

The use of a bow string hook connector, as described, has presented problems. First, in the use of a bow string connector having the configuration of a hook, the force transmitted from a bow string to a draw cable through the hook connector may not be transmitted evenly along a force line in alignment with the draw cable and the bow string. Accordingly, there may be some shifting of the location of the hook connector with respect to the bow string or draw cable in transmitting the force load with the result that some kinking or bending of the draw cable may result which weakens the draw cable.

Also, in the use of a hook connector, the force transmitted from the hook to the bow string may be concentrated at the point on the bow string where the string passes over the hook. This concentration of forces may accelerate weakening of the bow string at this point to produce bow string failure.

As a solution to the above problems, it would be desirable to have a bow string holder which transmits forces from a bow string to a draw cable along a force line which substantially coincided with the axes of the bow string and the draw cable supporting the bow string holder. This would alleviate the problem of kinking or bending of the draw cable.

Further, it would be desirable to have a bow string holder whose configuration was such that forces transmitted to the bow string would not be concentrated at a single point of the bow string. This would reduce the incidence of failure of bow strings at their point of connection to a bow string holder.

SUMMARY OF THE INVENTION

In providing a solution to the above problems, the present invention provides a compound bow in combination with bow string holders which are each supported through a cable connection to eccentrically mounted pulleys positioned at the outer ends of the bow limbs. The compound bow, as is conventional, includes a center portion having a handle formed thereon, a lower limb and an upper limb connected to the center portion, and eccentrically mounted bow string pulleys mounted at the outer ends of each of the limbs. During the draw of the bow by the archer, the bow string pulleys undergo some degree of rotation about their eccentric mountings which has the effect of lengthening the bow limbs so that less force is then required to bend the limbs.

Each of the bow string holders includes a shaft that is connected at its outer end through a cable to one of the eccentrically mounted pulleys. At least a pair of bow string support members extend from either side of the shaft at the inner end of the shaft and each support member includes an upwardly extending outer end which is shaped and positioned to maintain a bow string between the outer end and the shaft of the bow string holder. The ends of a bow string may, thus, be readily connected to the bow string holders by passing a closed loop at either end of the bow string over one of the support members, then under the bow string holder, and then over the other of the support members.

Preferably, the bow string holders have two bow string support members which extend from either side of the shaft with the support members in aligned relation. Each support member preferably includes a curved upper surface which curves upwardly toward the outer end of the shaft to merge into the surface of the shaft and also curves upwardly toward the upwardly extending outer end on the support member to merge into the surface of the outer end. Also, the upper surface defines a low point which is situated between the shaft and the upwardly extending outer end. Preferably, the curved upper surface on each support member has a curvature that approximates the curvature of the outer surface of a bow string to uniformly contact the bow string as it passes over the upper surface.

Preferably, each of the upwardly extending outer ends on the support members includes a convexly curved upper surface at its outer extremity. This facilitates the slipping of a bow string over the upper ends in attaching the bow string to the bow string holder.

Also, the bow string support members preferably have a transversely curved outer surface. A bow string which is in engagement with the bow string holder is, thus, curved and lies against a transversely curved outer surface of the support member as the bow string passes over the support member.

The bow string support members also preferably include a lower surface with the lower surfaces of two of the support members on a bow string holder merging together to form a continuous lower surface that extends across the bottom of the bow string holder. Preferably, the transversely curved outer surface on each bow string support member has a generally elliptical curvature while the shaft of the bow string holder has a generally cylindrical configuration.

In ensuring a firm connection between the bow string holder and a draw cable connecting the holder to an eccentrically mounted pulley, the shaft of the bow string holder is preferably in cast contact with the draw cable. This provides a strong connection between the holder and the draw cable and also ensures that forces applied to the bow string holder are transmitted uniformly into the draw cable.

In addition to providing a bow string holder in combination with a compound bow, as described above, the present invention also provides a bow string holder per se which includes a shaft having an outer end that is connectable to a draw cable for a compound bow. A pair of bow string support members extend from either side of the shaft at its inner end and each of the support members has an outer end that extends in the direction of the outer end of the shaft. A curved upper surface is provided on each of the support members with the upper surface curving upwardly toward the outer end of the shaft to merge into the surface of the shaft. Also, the upper surface curves upwardly toward the upwardly extending outer end of the support member to merge into the surface of the outer end and a low point is defined by the upper surface which is situated between the shaft and the upwardly extending outer end.

In addition to a bow string support member, as described, the present invention also pertains to the bow string support member in combination with a draw cable. In this embodiment of the invention, the shaft of the bow string holder is in cast contact with the draw cable to provide a firm connection between the bow string holder and draw cable.

BRIEF DESCRIPTION OF THE DRAWINGS

To further illustrate an embodiment of the invention, reference is made to the accompanying drawing in which.

DETAILED DESCRIPTION

Figure 1:
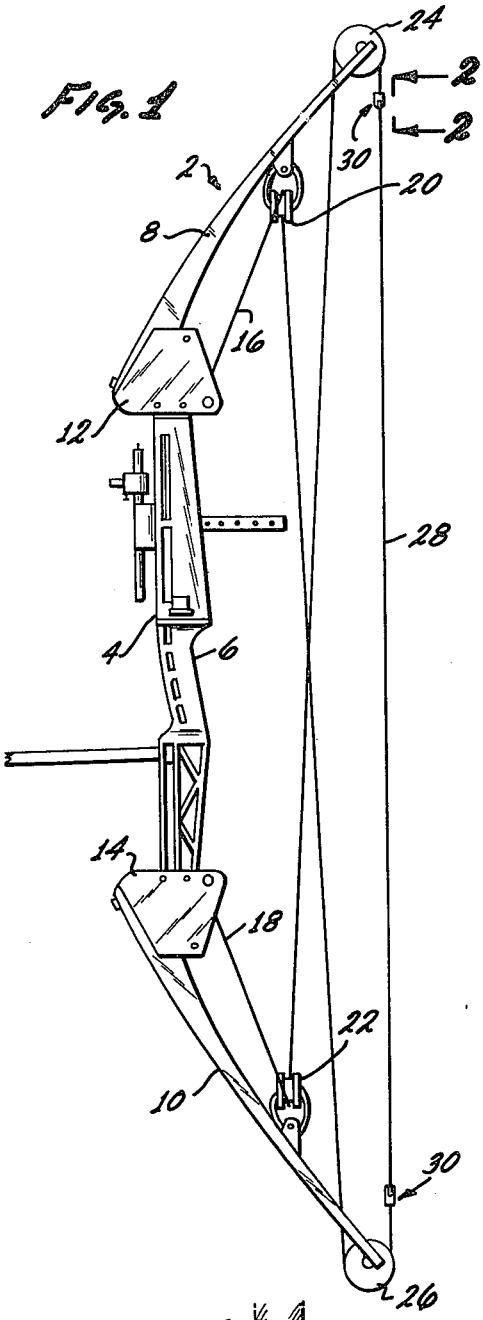
FIG. 1 is a side elevational view of a compound bow having a bow string supported through bow string holders which are connected to eccentrically mounted pulleys positioned at the ends of the bow limbs.

FIG. 1 illustrates a compound bow 2 having a center portion 4 with a handle 6 formed thereon. An upper limb 8 and a lower limb 10 are connected to the center portion 4 through an upper bracket 12 and a lower bracket 14. By adjustment of the brackets 12 and 14 in a known manner, the position of the limbs 8 and 10 may be varied with respect to the center portion 4 to change the draw weight of the bow 2.

Draw cables 16 and 18 are connected to the respective brackets 12 and 14 with the draw cables passing over respective draw pulleys 20 and 22. The draw cables 16 and 18 are then respectively connected to eccentrically mounted pulleys 24 and 26 with the draw cables then connected through bow string holders 30 to a bow string 28.

The compound bow 2, as shown in FIG. 1, is conventional except for the bow string holder 30. For a more detailed description of a compound bow, reference is made to U.S. Pat. No. 3,486,495, issued Dec. 30, 1969.

Figure 2:
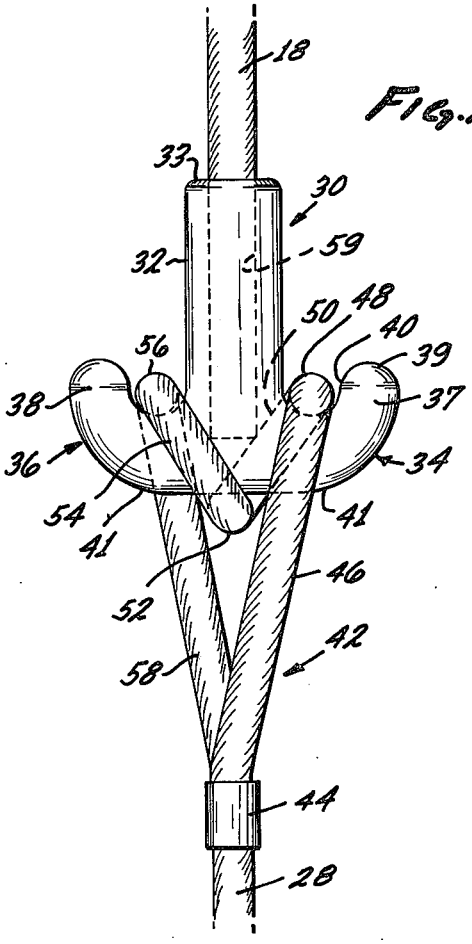
FIG. 2 is an elevational view of the bow string holder of FIG. 1 taken along line 2—2 and illustrating the connection of a closed loop at the end of a bow string to the bow string holder.

FIG. 2, which is an elevational view taken along the line 2—2 of FIG. 1, illustrates the bow string holder 30 in detail and the manner in which the holder is used in supporting one end of the bow string 28. The bow string holder 30 includes a shaft 32 which may have a generally cylindrical exterior configuration and an outer end 33 connected through draw cable 18 to eccentrically mounted pulley 24.

In securing the shaft 32 to draw cable 18, the bow string holder 30 is preferably formed by casting with the shaft being cast around the draw cable with the shaft in cast contact with the draw cable surface. This has been found to be a convenient means of forming a suitably firm connection between the bow string holder 30 and a draw cable, such as draw cable 18. Moreover, by casting the shaft 32 about draw cable 18, the axis of the shaft is in alignment with the axis of the draw cable to transmit forces from the bow string holder to the draw cable along the axis of the draw cable.

At least a pair of bow string support members, such as members 34 and 36, extend from either side of the shaft 32 of bow string holder 30 with the support members being connected to the shaft at its inner end. Support member 34 includes an upwardly directed outer end 37 while support member 36 includes an upwardly directed outer end 38. Both the upwardly directed outer ends 37 and 38 are shaped and positioned to maintain a bow string between the outer end and the shaft 32. Both of the upwardly directed outer ends 37 and 38 preferably include a curved surface 39 at their upper extremities which preferably has a generally convex curvature to assist in slipping a taut bow string over the curved surface.

As illustrated, the upwardly directed outer ends 37 and 38 each have a height that is sufficient to retain a bow string on a curved upper surface 40 situated between the upwardly directed outer end and the shaft 32 of holder 30. The curved upper surface 40 on each of support members 34 and 36 curves upwardly toward the outer end of the shaft 32 to merge smoothly into the outer surface of the shaft. Also, the upper surface 40 curves upwardly toward the upwardly extending outer end, such as outer end 37, to merge smoothly into the surface of the outer end. At a point between the shaft 32 and the upwardly extending outer end 37, the upper surface 40 defines a low point and, preferably, the curvature of the upper surface approximates the curvature of a bow string. Thus, when a bow string passes over the curved surface 40, it is generally uniformly supported through contact with the curved surface.

Both of support members 34 and 36 include a lower surface 41. With support members 34 and 36 in alignment with each other and positioned at the inner end of shaft 32, the lower surfaces 41 for the two support members are in aligned relation. The lower surfaces 41 thus merge to form a continuous lower surface across the bottom of the bow string holder 30.

In securing the bow string 28 to a bow string holder 30, as illustrated in FIG. 2, a closed loop 42 is formed in the end of the bow string by a ring or clamp 44 which encircles the bow string and holds the portions of the bow string together which form the closed loop. In connecting the closed loop 42 to bow string holder 30, an advancing loop portion 46 may be shaped to form a bend 48 which is passed over the curved surface 39 on upwardly directed outer end 37. The bend 48 then passes over curved upper surface 40 with the upper surface having a curvature which approximates the outer curvature of the bow string. A return loop portion 50, then passes downwardly and diagonally from bend 48 with respect to the support member 34 with the return loop portion positioned on the opposite side of the support member from the advancing loop portion 46. After passing downwardly to the bottom of the bow string holder 30, the return loop portion is then shaped to form a bend 52 which passes over lower surface 41 and is positioned at approximately the midpoint of the bow string holder 30, i.e., where the axis of shaft 32 intersects the lower surface of the bow string holder.

After passing over the lower surface 41 at bend 52, an advancing loop portion 54 leads upwardly and diagonally with respect to support member 36 and is then curved to form a bend 56 that passes over the surface 40 on the support member 36. After passing over the surface 40 at the bend 56, a return loop portion 58 leads downwardly and is joined to the remainder of the bow string 28 by the ring or clamp 44.

In connecting the closed loop 42 to bow string holder 30, as described, the loop may first be passed over one of the support members, either support member 34 or support member 36. Following this, the closed loop is curved as described and is passed behind and under the bow string holder 30 with the loop then engaging the other of the support members. With the closed loop 42 joined to the bow string holder 30, as illustrated in FIG. 2, the closed loop is supported through intimate contact with the curved surfaces of the bow string holder. Also, the bow string 28 is supported by the bow string holder at more than one point. Thus, the stresses in the bow string through contact with the bow string holder are not concentrated at one point.

As shown in FIG. 2, the bends 48 and 56, where bow string 28 passes over the support members 34 and 36, are located equally distant from the axis of the shaft 32. Thus, a resolution of the forces in the advancing loop portion 46 and the return loop portion 58 lies along the axis of the shaft 32 and the draw cable 18. This permits an even transmission of forces from bow string 28 to draw cable 18 without kinking of the draw cable or shifting of the position of the bow string holder 30 as would result if the forces transmitted to the bow string holder were not directed along the axis of shaft 32.

Figure 3:
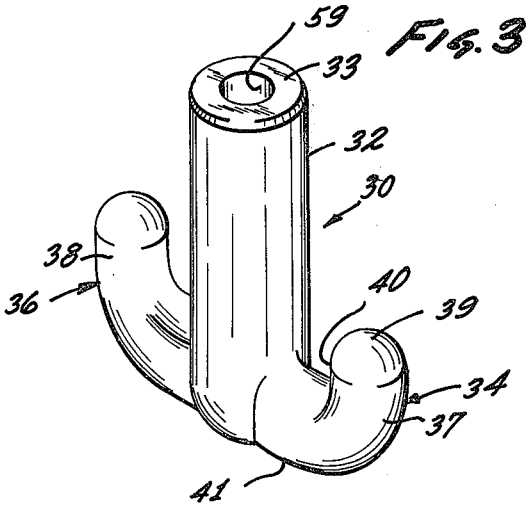
FIG. 3 is a pictorial view of the bow string holder of FIG. 2.

FIG. 3 is a perspective view of the bow string holder 30 shown in FIG. 2. As illustrated, the bow string support members 34 and 36 are positioned in aligned relation on opposite sides of the shaft 32. An axial hole 59 may be formed in the outer end 33 of the shaft 32 and the axial hole may be threaded or otherwise contoured to connect with a correspondingly contoured connection at the end of a draw cable. This then permits replacement of the bow string holder 30 without replacement of the draw cable to which the bow string holder is connected. As described previously, the shaft 32 is preferably cast about the draw cable to form a unitary structure in which the shaft is in cast contact with the draw cable.

Figure 4:
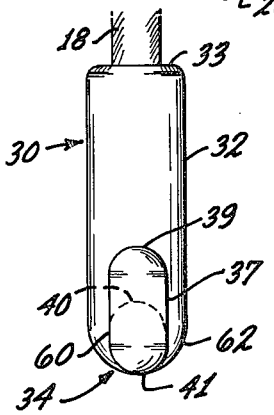
FIG. 4 is a partial side elevational view of the bow string holder indicating the cross-sectional configuration of the bow string support members and their position relative to the shaft of the bow string holder.

FIG. 4 is a partial end view of the bow string holder 30 as taken from the right in FIG. 2. As illustrated, the support member 34 includes a transversely curved surface 60 which defines a surface of the transversely extending portion of the support member which is perferably of a generally elliptical nature. By reason of the transversely curved surface 60, the bow string is curved as it passes in contacting relation over the transversely curved surface. This serves to provide more intimate contact between the bow string holder 30 and bow string 28. Also, the shaft 32 may include a curved inner surface 62 which may be different in its curvature than transversely curved surface 60. Thus, as the bow string passes beneath the bow string holder 30 to form the bend 52, as illustrated in FIG. 2, the bow string will pass over transversely curved surface 60, over a portion of the curved surface 62, and over the lower surface 41. In passing over these curved surfaces, the bow string is, thereby, secured in firm engagement with the bow string holder 30.

I claim:

1. In a compound bow having a center portion with a handle formed thereon, a lower limb and an upper limb connected to said center portion, and eccentrically mounted bow string pulleys mounted at the outer ends of each of said limbs for supporting a cable and bow string, the improvement comprising:

bow string holder means constructed and disposed to be supported by each of said eccentrically mounted pulleys;

each of said bow string holder means having shaft means and constructed to be connected at its outer end through the cable to one of said pulleys;

the bow string holder means further including a pair of aligned bow string support means each extending at its inner end from an opposite side of said shaft means;

each of said support means having an upwardly extending outer end which is shaped and positioned in spaced relationship to the shaft means to maintain the bow string between said outer end and said shaft;

curved upper surface means on each of said support means;

said upper surface means curving upwardly toward the outer end of said shaft means to merge into the surface of said shaft;

said upper surface means also curving upwardly toward said upwardly extending outer end of the support means to merge into the surface of said outer end and to define with the upper end of the support means and the shaft means a recess for receiving the bow string;

transversely curved outer side surface means on each of said support means for facilitating the disposition of the bow string in frictional relationship with the support means along an extended length of the bow string;

said transversely curved outer side surface means merging smoothly into said upper surface means on each of the support means for facilitating the disposition of the bow string in frictional relationship with the support means along an extended length of the bow string;

lower curved surface means on each of said support members;

the lower surface means on said support means merging together to form a continuous and straight lower surface extending across the bottom of said bow string holder means for facilitating the disposition of the bow string in symmetrical relationship with the shaft means, and said transversely curved outer side surface means on each of said support means merging smoothly into the curved lower surface on the support means for facilitating the disposition of the bow string in frictional relationship with the support means along an extended length of the bow string, said upper surface means, and transversely curved outer side surface means, and said lower surface means being constructed and disposed to provide a relatively uniform contact between the bow string and the bow string holder means along the extended length of the bow string holder means for facilitating a uniform support for the bow string in a symmetrical relationship to the shaft means and for preventing stress concentrations in the bow string in its engagement with said bow string holder means.

2. The combination of claim 1 wherein each of said bow string holders has two bow string support members which extend from either side of said shaft, and said support members are in aligned relation with each other.

3. The combination of claim 1 wherein said curved upper surfaces each have a curvature that approximates the curvature of the outer surface of said bow string such that the bow string is uniformly contacted by said curved upper surface as it passes over said upper surface.

4. The combination of claim 1 including convexly curved upper surfaces at the extremities of said outer ends to facilitate the slipping of a bow string over said upper ends.

5. The combination of claim 1 wherein said shaft is in cast contact with the cable connecting said shaft to an eccentrically mounted pulley.

6. The combination of claim 1 wherein said transversely curved outer side surface means have a generally elliptical curvature to facilitate frictional engagement with the bow string, and said shaft means has a generally cylindrical configuration to facilitate engagement of the cable.

7. In combination for use with a compound bow having a draw cable, comprising a bow string, shaft means having an outer end constructed to retain the draw cable in a fixed relationship;

a pair of aligned bow string support means each extending at its inner end from an opposite side of said shaft means in integral and symmetrical relationship to the shaft means;

each of said support means having outer end means which extends in the same direction as the outer end of said shaft means and in spaced relationship with said shaft means and which is shaped and positioned relative to said shaft means to maintain the bow string between said outer end means and said shaft means in frictional relationship with said support means in substantially a complete loop of the bow string and in symmetrical relationship with the shaft means and the substantially complete loop of the bow string on the other one of the support means;

curved upper surface means on each of said support means;

said upper surface means curving upwardly toward the outer end of said shaft means and merging into the surface of said shaft means;

said upper surface means curving upwardly towards said upwardly extending outer end means and merging into the surface of said outer end means to define a recess for receiving and holding to bow string in the substantially complete loop in frictional relationship with the upper surface means;

transversely curved outer side surface means on each of said support means;

said transversely curved outer side surface means merging smoothly into said upper surface means on each of said support means to facilitate a frictional relationship between the bow string and the support means in the substantially complete loops of the bow string along an extended length of the bow string;

curved lower surface means on each of said support means;

the lower surface means on the support members merging together to form a continuous and straight lower surface extending across the bottom of said bow string holder to facilitate a frictional relationship between the bow string and the support means in the substantially complete loops of the bow string along an extended length of the bow string, and said transversely curved outer side surface means on each of said support members merging smoothly into the curved lower surface on the support member to facilitate a frictional relationship between the bow string and the support means in the substantially complete loops of the bow string along an extended length of the bow string, each of the substantially complete loops of the bow string being passed over and around the upper surface means of an individual one of said support means in frictional relationship with the upper surface means, around the side surface means of an individual one of the bow string holder means in frictional relationship with the side surface means, around and under the lower surface means of an individual one of said bow string holder means in frictional relationship with the lower surface means of the bow string holder means, and then over and around the upper surface of the other side surface means of an individual one of said support means in frictional relationship with such side surface means of such support member means and the closed loop being curved through contact with said upper surface means, said transversely curved outer side surface means, and said lower surface means to provide a substantially uniform contact between the bow string and the bow string holder means in each of the substantially complete loops of the bow string and to provide uniform support for each of the substantially complete loops of the bow string while preventing stress concentrations in the closed loop in its engagement with said bow string holder means.

8. The combination of claim 7 wherein said curved upper surfaces each have a curvature that approximates the curvature of the outer surface of a bow string such that the bow string is uniformly contacted by said curved upper surface as it passes over said upper surface.

9. The combination of claim 8 including a draw cable connected to the outer end of said shaft, and said shaft in cast contact with said draw cable.

10. The combination of claim 7 including convexly curved upper surface means at the extremities of said outer ends to facilitate the slipping of the substantially complete loops of the bow string over said upper ends.

11. The combination of claim 7 wherein said transversely curved outer side surface means have a generally elliptical curvature to facilitate a frictional relationship between the side surface means and the bow string in each of the substantially complete loops of the bow string, and said shaft means has a generally cylindrical configuration to facilitate the disposition of the draw cable in the shaft means in fixed relationship to the shaft means and in symmetrical relationship to the substantially complete loops of the bow string.

12. The combination of claim 11 including a draw cable connected to the outer end of said shaft, and said shaft in cast contact with said draw cable.

13. The combination of claim 7 including a draw cable connected to the outer end of said shaft, and said shaft in cast contact with said draw cable.

14. In combination in a compound bow, holder means formed at one end with a central shaft means having a hollow configuration and with at least a pair of support means extending in a symmetrical relationship to each other from the shaft means and defining a continuous and straight surface at the end opposite to the central shaft means and further defining the opposite end of the holder means.

draw cable means disposed within the hollow configuration of the central shaft means in fixed relationship to the holder means and extending in a first direction from the holder means, and bow string means having a closed loop portion extending integrally in at least a pair of substantially complete loops with each of the loops extending around an individual one of the support means of the pair in the holder means for support by the holder means and the closed loop position having a second portion extending integrally draw cable means disposed within the hollow configuration of the central shaft means in fixed relationship to the holder means and extending in a first direction from the holder means, and from the closed loop portion in a second direction opposite to the first direction, each of the substantially complete loops in the bow string means having a symmetrical relationship to the other substantially complete loop and the draw cable means and engaging in frictional relationship the continuous and straight surface on the holder means:

the holder means being constructed to hold the draw cable means in a fixed relationship within the hollow configuration of the central shaft means and being further constructed to provide a frictional force on each of the substantially complete loops of the closed loop portion of the bow string means for retaining the closed loop portion of the bow string means in a symmetrical relationship to the draw cable means.

the holder means being constructed to hold the draw cable means in a fixed relationship within the hollow configuration of the central shaft means and being further constructed to provide a frictional force on each of the substantially complete loops of the closed loop portion of the bow string means for retaining the closed loop portion of the bow string means in symmetrical relationship to the draw cable means.

15. In combination set forth in claim 14, clamp means engaging opposite ends of the closed loop portion of the bow string means to retain such portion in the closed loop.

16. In the combination set forth in claim 15 each of the support means in the holder means being provided with curved exteriors and extending upwardly from the shaft means in spaced relationship to the shaft means to define a recess for receiving an individual one of the substantially complete loops of the closed loop portion of the bow string means.

17. In combination in a compound bow, draw cable means extending in a first direction, bow string means having at one end of a closed loop portion extending integrally in a first direction and defined by two substantially complete loops and extending from the closed loop portion in a second direction opposite to the first direction, each of the two substantially complete loops having a symmetrical relationship to the draw cable means and the the closed loop portion and the extensions of the bow string means in the first and second directions being integral, the draw cable means and the bow string means defining an endless and constrainable cable for propelling an arrow from the bow, other complete loop, clamp menas retaining the closed extension of the bow string means in the first and second opposite direction, and holder means having a hollow control shaft at one end for receiving the draw cable means and for retaining the draw cable means in a fixed relationship and having at least a pair of support means extending from the central shaft in a symmetrical relationship to each other and to the shaft and in a spaced relationship to the shaft for receiving and retaining the two substantially complete loops of the closed loop portion of the bow string means in a frictional and symmetrical relationship, the pair of support means being provided with a straight and continuous surface at the end opposite to the hollow control shaft to define the opposite end of the holder means and to facilitate the symmetrical relationship between the holder means and the two substantially complete loops of the closed loop portion of the bow string means, each of the substantially complete loops of the closed loop portion of the bow string means being disposed on an individual one of the support means of the holder means and having a symmetrical relationship to the central shaft and the other substantially complete loop to receive from the support means frictional forces vectorially extending in he same direction as the draw cable means.

18. In the combination set forth in claim 17, each of the support means extending upwardly from the central shaft in spaced relationship to the shaft to define a recess for recessing the associated one of the substantially complete loops of the closed loop portion of the bow string means.

19. In combination in a compound bow for drawing and releasing an arrow to propel the arrow from the bow, holder means formed with a central shaft means having a hollow configuration and with at least a pair of support means extending in a symmetrical relationship to each other from the shaft means;

draw cable means disposed within the hollow configuration of the central shaft means in a fixed relationship to the holder means and extending in a first direction from the holder means, and bow string means having a closed loop portion extending around the pair of support means in the holder means for support by the holder means and having a portion extending from the closed loop portion in a second direction opposite to the first direction to define with the draw cable means an endless and constrainable cable for drawing and releasing the arrow from the bow to propel the arrow from the bow;

the holder means being constructed to hold the draw cable means in a fixed relationship within the hollow configuration of the central shaft means and being further constructed to provide a frictional force on the closed loop portion of the bow string means along an extended length of the closed loop portion for retaining the closed loop portion of the bow string means in symmetrical relationship to the draw cable means, clamp means engaging opposite ends of the closed loop portion of the bow string means to retain such portion in the closed loop, each of the support means in the holder means being provided with curved exteriors and extending upwardly from the shaft means in spaced relationship to the shaft means to define a recess for receiving the closed loop portion of the bow string means, each of the support means having a lower surface aligned with the lower surface of the other support means to define a linear relationship at their lowest positions for receiving in a frictional relationship the closed loop portion of the draw cable means at an intermediate position along the closed loop portion.

20. In combination in a compound bow for drawing and releasing an arrow to propel the arrow from the bow, draw cable means extending in a first direction, bow string means having a closed loop portion at one end and extending from the closed loop portion in a second direction opposite to the first end to define with the draw cable means an endless and constrainable cable for drawing and releasing the arrow to propel the arrow from the bow, clamp means retaining the closed loop portion at the end of the bow string means, and holder means having a hollow central shaft at one end for retaining the draw cable means in a fixed relationship and having at least a pair of support means extending from the central shaft in a symmetrical relationship to each other and to the shaft and in a spaced relationship to the shaft to retain the closed loop portion of the bow string means, the closed loop portion of the bow string means being disposed on the support means of the holder means in a continuous loop extending through more than one revolution and having a symmetrical relationship to the central shaft to receive from the support means frictional forces vectorially extending in the same direction as the draw cable means for retaining the bow string means on the support means of the holder means each of the support means extending upwardly from the central shaft in spaced relationship to the shaft to define a recess for recessing the closed loop portion of the bow string means, each of the support means having a bottom surface having a linear configuration at its lowest position, the linear configuration for each support means being aligned with the linear configuration for the other support means in a direction substantially perpendicular to the first and second directions.

21. In the combination set forth in claim 20, the surfaces of the support means being curved to facilitate the disposition of the closed loop portion of the bow string means against the support means and the recess between each of the support means and the shaft being provided with a curvature corresponding substantially to the curvature of the bow string.

22. In the combination set forth in claim 21, the support means having upper curved surfaces to facilitate the disposition of the closed loop portion of the bow string means over the upper curved surfaces and into the recesses between the support means and the shaft.

23. In the combination set forth in claim 21, the closed loop portion of the bow string means having a first bend passing over the recess of one of the support means and around such support means in frictional relationship with the support means and having a second bend passing over the bottom surface of the support means and around the support means in frictional relationship with the support means and having a third bend passing over the recess of the other support means and around such support means in frictional relationship with the support means.

* * * * *